US011612779B2

(12) United States Patent
Schumacher

(10) Patent No.: US 11,612,779 B2
(45) Date of Patent: Mar. 28, 2023

(54) WATER JUG/ WATER CAN EXERCISE DEVICE/ EQUIPMENT SYSTEM

(71) Applicant: Timothy Karl Schumacher, Bridgewater, VA (US)

(72) Inventor: Timothy Karl Schumacher, Bridgewater, VA (US)

( * ) Notice: Subject to any disclaimer, the term of this patent is extended or adjusted under 35 U.S.C. 154(b) by 77 days.

(21) Appl. No.: 17/204,646

(22) Filed: Mar. 17, 2021

(65) Prior Publication Data

US 2022/0134166 A1 May 5, 2022

Related U.S. Application Data

(60) Provisional application No. 63/109,571, filed on Nov. 4, 2020.

(51) Int. Cl.
*A63B 21/06* (2006.01)
*A63B 21/065* (2006.01)
*A63B 21/072* (2006.01)

(52) U.S. Cl.
CPC ..... *A63B 21/0602* (2013.01); *A63B 21/065* (2013.01); *A63B 21/072* (2013.01)

(58) Field of Classification Search
CPC ..... A63B 21/06–0603; A63B 21/065; A63B 21/072–075; B65D 88/1656; B65D 5/40; B65D 21/02–0204; B65D 21/0209; A45F 3/16; A45F 2003/155; A45F 2200/0583; A63H 33/08
See application file for complete search history.

(56) References Cited

U.S. PATENT DOCUMENTS 4,199,140 A * 4/1980 Ferretti ..... A63B 21/0728 482/106
5,817,012 A * 10/1998 Schoendorfer .... A61B 10/0035 600/362
6,241,641 B1 * 6/2001 Sawyer ..... A63B 21/072 482/108
8,608,628 B2 * 12/2013 Mathews ..... A63B 21/0728 482/109
8,951,173 B2 * 2/2015 Kovach ..... A63B 21/0004 482/110
9,352,873 B2 * 5/2016 Dorn ..... B65D 1/0223
10,434,358 B2 * 10/2019 Chen ..... A63B 23/0205
11,007,393 B2 * 5/2021 Reinstein ..... A63B 21/075
2009/0163329 A1 * 6/2009 Pearce ..... A63B 21/072 482/93
2009/0308136 A1 * 12/2009 Wang ..... A61B 5/082 73/23.4
2012/0283072 A1 * 11/2012 Jones ..... A63B 21/4035 482/93

(Continued)

FOREIGN PATENT DOCUMENTS

GB 2528105 A * 1/2016 ..... A63B 21/00069
WO WO-03052865 A2 * 6/2003 ..... G01N 13/04

*Primary Examiner* — Loan B Jimenez
*Assistant Examiner* — Kathleen M Fisk
(74) *Attorney, Agent, or Firm* — Benjamin C. Rothermel, Esq.

(57) ABSTRACT

An exercise device includes a jug including a first external cutout portion and a second external cutout portion together forming an external cutout having a cross shape in the outer surface of the jug. The jug also includes a first, second, and third handle. The exercise device is configured to allow a user's wrist and forearm to enter the cutout portions.

5 Claims, 1 Drawing Sheet

(56) References Cited

U.S. PATENT DOCUMENTS

| | | | | |
|---|---|---|---|---|
| 2013/0137556 | A1* | 5/2013 | Farber | A63B 21/072 482/110 |
| 2014/0038306 | A1* | 2/2014 | Berthier | B01L 3/50273 436/172 |
| 2014/0046149 | A1* | 2/2014 | Simpson | A61B 5/14532 600/316 |

* cited by examiner

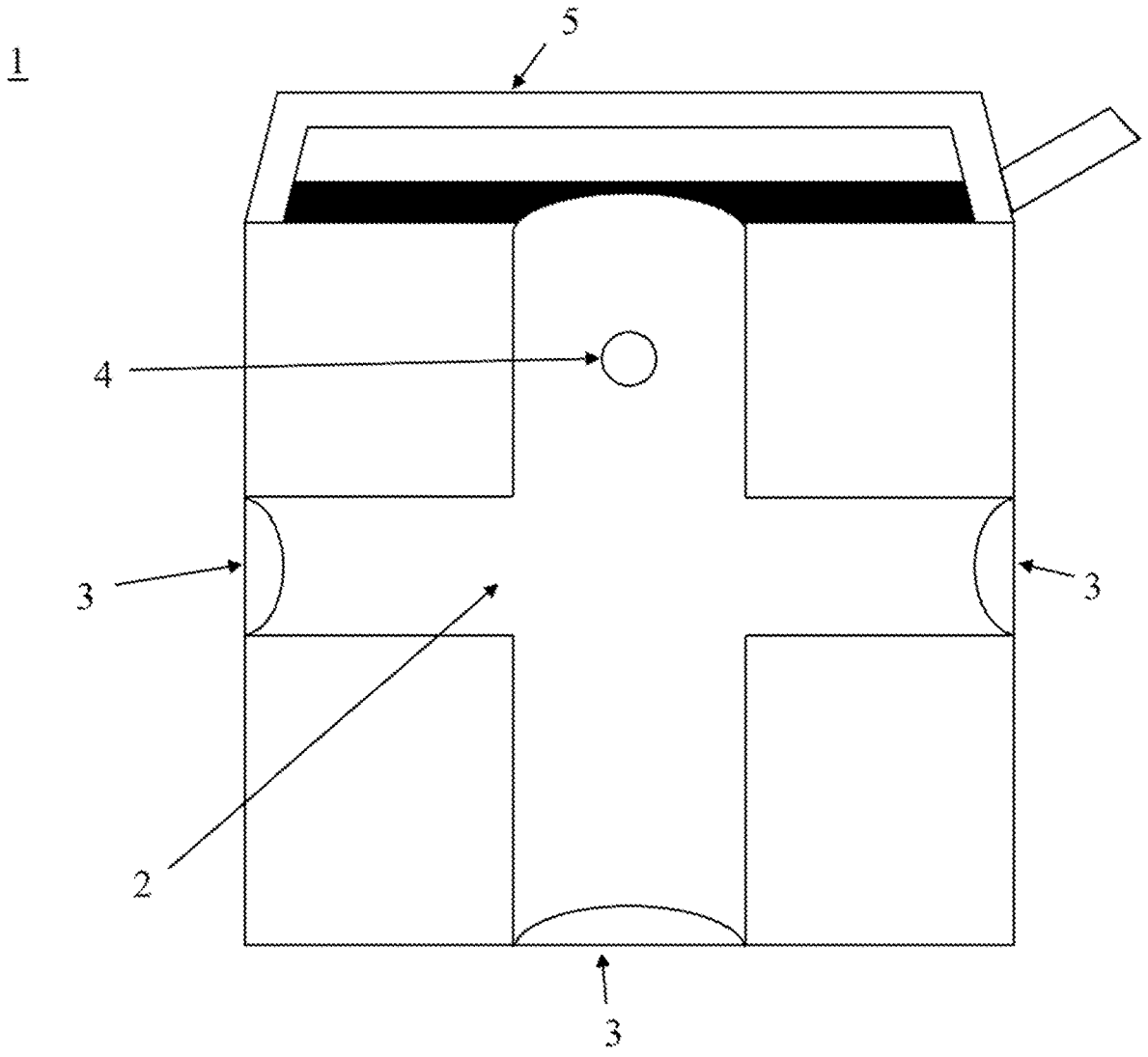
1
5
4
3
3
2
3

WATER JUG/ WATER CAN EXERCISE DEVICE/ EQUIPMENT SYSTEM

CROSS-REFERENCE TO RELATED APPLICATION

This application claims the benefit of U.S. Provisional Patent Application No. 63/109,571, filed on Nov. 4, 2020, which is hereby incorporated by reference for all purposes as if fully set forth herein.

BACKGROUND

Field

The idea of this invention is based off of using a water jug/water can as a weight to exercise with by allowing the user to empty or fill the jug/can with water or sand to the appropriate weight level.

Discussion of the Background

The issue with using a standard water jug/can is that the when the user attempts to do a bicep or butterfly curls the shape of the jug/can interferes with the wrist and elbow and does not allow the user to get full flex, meaning they cannot bring the jug all the way up to the chest without experiencing pain or discomfort.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

FIG. 1 is a water jug/can according to an exemplary embodiment.

DETAILED DESCRIPTION OF THE ILLUSTRATED EMBODIMENTS

By designing a jug/can 1, as shown in FIG. 1, with half-moon cutouts 2 in the shape of a cross, it allow the user to perform a complete bicep or butterfly curl by allowing the wrist and forearm to enter the half-moon cut out 2 area, thus avoiding any discomfort from contacting the jug/can 1. Handles 3 are connected between each of the half-moon cut out 2 areas at the sides of the jug/can 1.

The other issue with a standard water jug/can is that the user cannot safely attach a bench press or curling bar to the jugs/cans, which would allow the user to put water jugs/cans at both ends of the bar for increased weight and to allow the user to perform such exercises as squats, deadlifts and bench presses.

By positioning a hole 4 near the top of the water jug/can 1, it allows users to place any standard curling or bench press bar into the water jug/can 1 system and will allow the user to be able to attach standard weight bar clips and clamps which will safely lock the jugs in place. The jug/can 1 itself will have markings down the side of it to indicate the appropriate water to weight level from 5 to 150 pounds. The jug/can 1 has a large carrying handle 5.

Such an invention would be an advantage for those who live in a space with limited room or who cannot afford a lot of equipment. This water weight system can replace dumbbells, kettle bells, and standard weights. It's an all in one system. Plus it can still be used as a water jug container for watering plants, brushing your teeth while camping and drinking from it in the event city water becomes disabled due to natural disasters like hurricanes. As an Army Veteran who served in a remote region in Iraq, this invention would be great to replace the standard water jugs/cans we carried in our trucks because it would allow us to have our own portable gym while still allowing us to carry water.

I claim:

1. An exercise device, comprising:

a jug having a first side, a second side opposite and parallel to the first side, a third side extending perpendicularly between the first side and the second side, and a fourth side opposite and parallel to the third side and extending perpendicularly between the first side and the second side, the jug comprising a first external cutout portion extending between the first side and the second side, and a second external cutout portion perpendicular to the first external cutout portion and extending between the third side and the fourth side, the first external cutout portion and the second external cutout portion together forming an external cutout having a cross shape in the outer surface of the jug; and a first handle connected between the first external cutout portion at the first side of the jug, a second handle connected between the first external cutout portion at the second side of the jug, and a third handle connected between the second external cutout portion at the third side of the jug, wherein the exercise device is configured to allow a user's wrist and forearm to enter the external cutout.

2. The exercise device of claim 1, wherein each of the first external cutout portion and the second external cutout portion comprises a half-moon shape.

3. The exercise device of claim 1, further comprising a hole positioned near the top of the jug, wherein the exercise device is configured to allow a weight bar to enter the hole.

4. The exercise device of claim 1, further comprising markings down a side of the jug to indicate a water to weight level.

5. The exercise device of claim 1, further comprising a carrying handle.

* * * * *